US012648610B1

(12) United States Patent
Harris et al.

(10) Patent No.: US 12,648,610 B1
(45) Date of Patent: Jun. 9, 2026

(54) HEADGEAR WITH SHIELD RETAINER

(71) Applicant: Lion Group, INC., Dayton, OH (US)

(72) Inventors: Richard H. Harris, Beavercreek, OH (US); Liberty Malenich, Kettering, OH (US); Joseph Godfried Kreitz, Springfield, OH (US)

(73) Assignee: LION GROUP, INC., Dayton, OH (US)

( * ) Notice: Subject to any disclaimer, the term of this patent is extended or adjusted under 35 U.S.C. 154(b) by 0 days.

(21) Appl. No.: 18/971,826

(22) Filed: Dec. 6, 2024

(51) Int. Cl.
*A42B 3/22* (2006.01)

(52) U.S. Cl.
CPC ..... *A42B 3/223* (2013.01); *A42B 3/221* (2013.01); *A42B 3/222* (2013.01); *A42B 3/225* (2013.01)

(58) Field of Classification Search
CPC ..... A42B 3/223; A42B 3/221; A42B 3/222; A42B 3/225
See application file for complete search history.

(56) References Cited

U.S. PATENT DOCUMENTS 2,798,221 A * 7/1957 Bailey ..... A42B 3/228 2/10
3,081,460 A * 3/1963 Miller ..... A42B 3/228 2/431
3,110,034 A * 11/1963 Aileo ..... A42B 3/228 D29/107
3,310,811 A * 3/1967 Iacono, Jr. ..... A42B 3/08 128/201.24
3,400,407 A * 9/1968 Aileo ..... A42B 3/221 2/427
3,495,273 A * 2/1970 Aileo ..... A42B 3/228 2/6.4
3,585,638 A * 6/1971 Aileo ..... A42B 3/228 2/6.4
3,601,813 A * 8/1971 Aileo ..... A42B 3/228 2/6.4
3,748,657 A * 7/1973 Aileo ..... A42B 3/226 2/6.4
4,075,715 A * 2/1978 Cowgill ..... A42B 3/228 2/6.3

(Continued)

FOREIGN PATENT DOCUMENTS

CA 2767266 A1 8/2013
JP 2003082518 A 3/2003

(Continued)

*Primary Examiner* — Khaled Annis
(74) *Attorney, Agent, or Firm* — Thompson Hine LLP

(57) ABSTRACT

A headgear assembly including a body configured to fit on a head of a wearer, and a shield coupled to the body. The shield is movable between an extended position where the shield is positioned to cover at least part of a face of the wearer, and a retracted position where the shield is positioned to not cover the face of the wearer, or to cover less of the face of the wearer compared to when the shield is in the extended position. The assembly further includes a retaining mechanism including a first circumferentially extending surface located on one of the body or the shield, and a second circumferentially extending surface located on the other one of the body or the shield. The first and second surfaces are configured to be able to engage each other when the shield is in the retracted position to selectively retain the shield in the retracted position.

25 Claims, 8 Drawing Sheets

(56) References Cited

U.S. PATENT DOCUMENTS

| | | | | | |
|---|---|---|---|---|---|
| 4,170,042 | A * | 10/1979 | Aileo | A42B 3/228 | 2/424 |
| 4,227,520 | A * | 10/1980 | Lord | A42B 3/225 | 128/201.24 |
| 4,887,320 | A * | 12/1989 | Long | A42B 3/226 | 2/424 |
| 5,283,914 | A * | 2/1994 | James | A42B 3/16 | 128/201.24 |
| 5,467,480 | A * | 11/1995 | Baudou | A42B 3/222 | 2/424 |
| 5,517,691 | A | 5/1996 | Blake | | |
| 6,282,726 | B1 * | 9/2001 | Noyerie | A42B 3/225 | 2/424 |
| 6,969,478 | B1 | 11/2005 | Hetzel, Jr. | | |
| 8,484,767 | B2 | 7/2013 | Nakayama | | |
| D846,810 | S | 4/2019 | Akrapovic | | |
| 10,842,217 | B2 * | 11/2020 | Smallwood | A42B 3/12 | |
| D907,859 | S | 1/2021 | Williams | | |
| 11,064,755 | B1 * | 7/2021 | Williams | A42B 3/185 | |
| 11,213,089 | B2 | 1/2022 | Bohn | | |
| 11,751,623 | B2 | 9/2023 | Sernfält | | |
| 2004/0010833 | A1 * | 1/2004 | Heine | A42B 3/226 | 2/432 |
| 2010/0229288 | A1 * | 9/2010 | Higgins | G02B 27/0176 | 2/10 |
| 2011/0271429 | A1 * | 11/2011 | Nakayama | A42B 3/225 | 2/424 |
| 2011/0277224 | A1 * | 11/2011 | Okuma | A42B 3/225 | 2/9 |
| 2014/0317834 | A1 * | 10/2014 | Power | A42B 3/221 | 2/424 |
| 2015/0082520 | A1 * | 3/2015 | Cheng | A42B 3/226 | 2/411 |
| 2018/0338559 | A1 | 11/2018 | Plunkett | | |
| 2023/0301388 | A1 | 9/2023 | Paulson | | |
| 2025/0000195 | A1 * | 1/2025 | Rogers | A42B 3/223 | |

FOREIGN PATENT DOCUMENTS

| | | | |
|---|---|---|---|
| KR | 101670404 | B1 | 10/2016 |
| WO | 2014122255 | A1 | 8/2014 |

* cited by examiner

HEADGEAR WITH SHIELD RETAINER

The present invention relates to headgear having a shield, and more particularly, such headgear having a retaining device that can retain the shield in a predetermined position or positions.

BACKGROUND

Headgear is worn in a variety of industries and settings to protect the wearer from impacts, flying debris, sharp objects or other conditions. The headgear may also include a shield, visor, lens, eyewear protection or goggles (collectively termed a "shield" herein) to protect the wearer's eyes, and in some cases also protect surrounding areas on the wearer's face. The shield can in some cases be movable between differing positions such as a stowed/retracted position and a deployed/engaged position. However existing headgear may not provide a sufficient solution for retaining the shield in the stowed position/deployed position, and/or any intermediate positions.

SUMMARY

In one embodiment, the invention is a headgear assembly including a body configured to fit on a head of a wearer, and a shield coupled to the body. The shield is movable between an extended position where the shield is positioned to cover at least part of a face of the wearer, and a retracted position where the shield is positioned to not cover the face of the wearer, or to cover less of the face of the wearer compared to when the shield is in the extended position. The assembly further includes a retaining mechanism including a first circumferentially extending surface located one of the body or the shield, and a second circumferentially extending surface located on the other one of the body or the shield. The first and second surfaces are configured to be able to engage each other when the shield is in the retracted position to selectively retain the shield in the retracted position.

DETAILED DESCRIPTION

Figure 1:
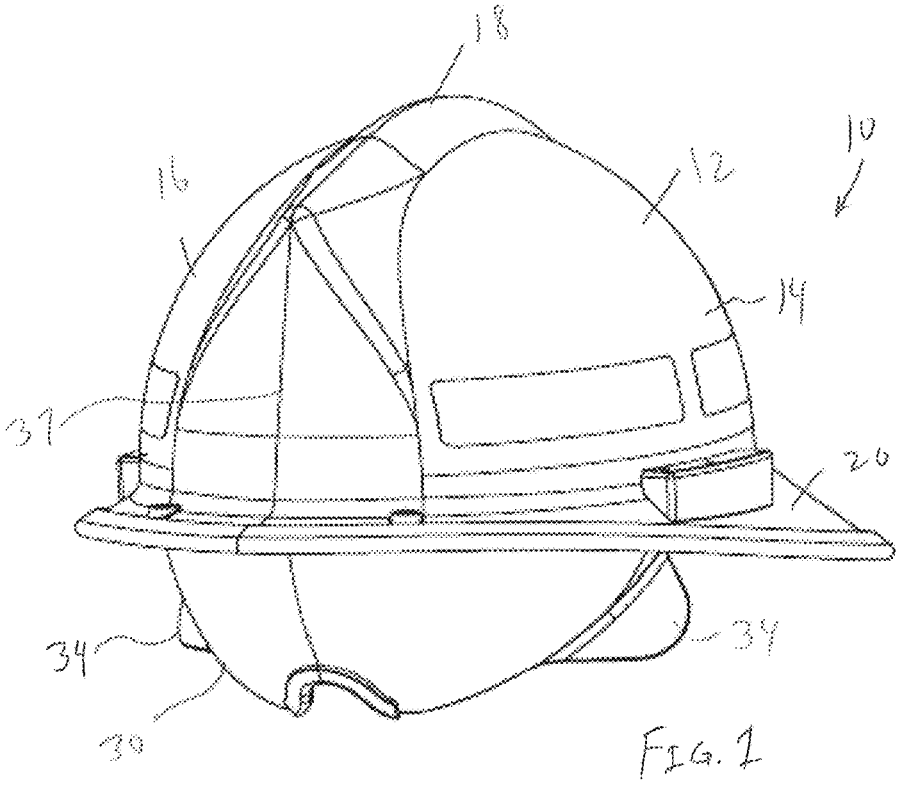
FIG. 1 is front perspective view of a helmet, with the shield in the extended position.
Figure 2:
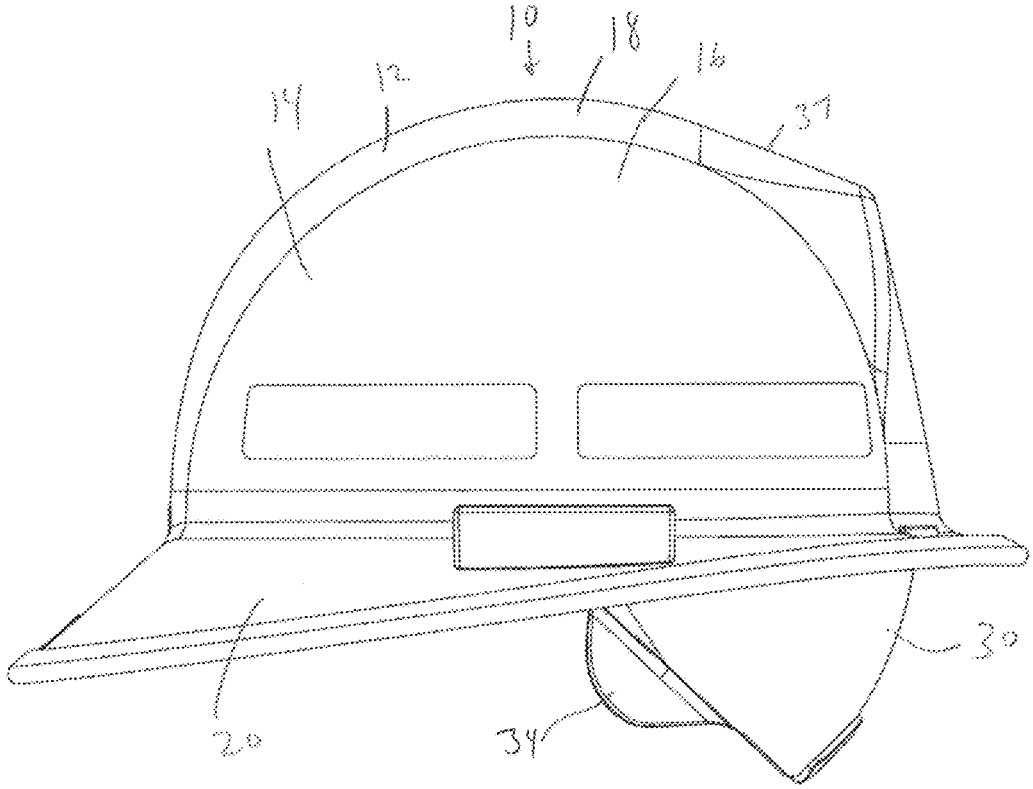
FIG. 2 is side view of the helmet of FIG. 1.

With reference to FIGS. 1-13, an assembly 10 can include or take the form of protective headgear, such as a firefighter helmet, generally designated 10. The headgear/helmet 10 can include a body 12 that can include or take the form of a relatively rigid, tough, impact-resistant, durable and abrasion resistant outer shell 14. The outer shell 14 can be made of or include various materials, including sheet molded composites, fiberglass, thermoplastics, metals, composites, polymers, leather and combinations thereof. The helmet 10 outer shell 14 can include a generally hemispherical body portion 16, with a peaked ridge 18 at least partially extending in the front-to-rear direction of the outer shell 14 to provide improved strength and impact resistance to the helmet 10 outer shell 14. The helmet 10/outer shell 14 can also include an outwardly-extending brim 20 extending around the lower rim of the body 16 to provide further protection to the wearer from runoff water, falling embers, material and the like, and provide shade.

Figure 3:
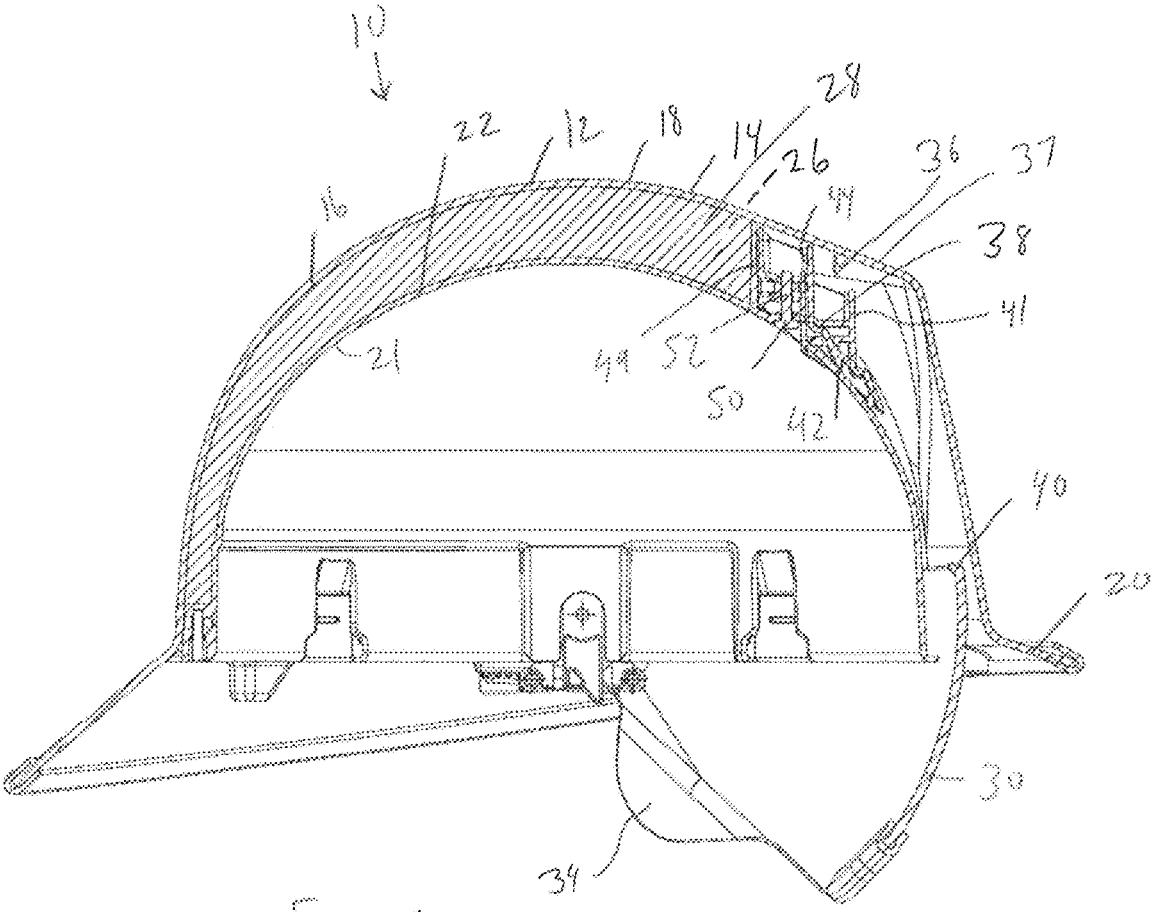
FIG. 3 is a side cross section of the helmet of FIG. 1, with the shield in the extended position.
Figure 4:
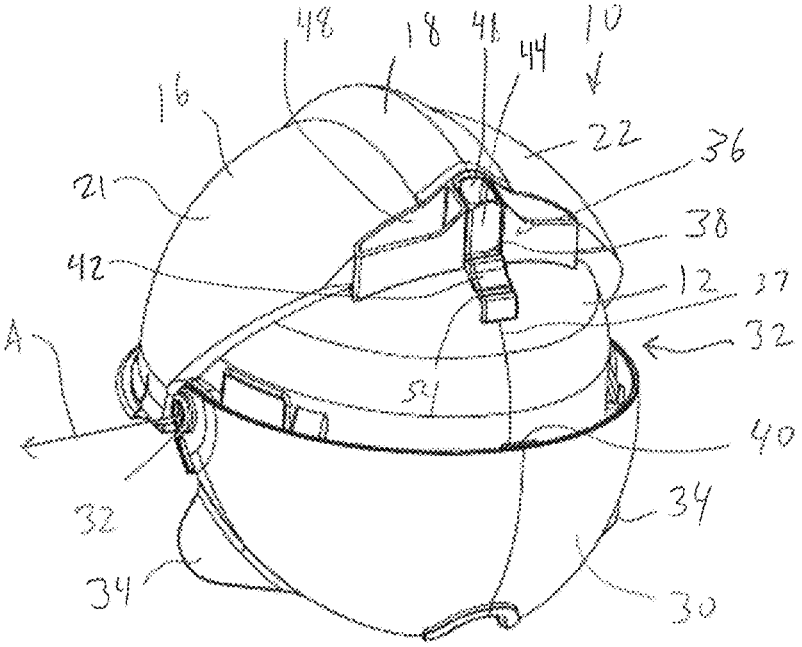
FIG. 4 is another front perspective view of the helmet of FIG. 1, with the outer shell removed for visibility purposes and the shield in the extended position.
Figure 5:
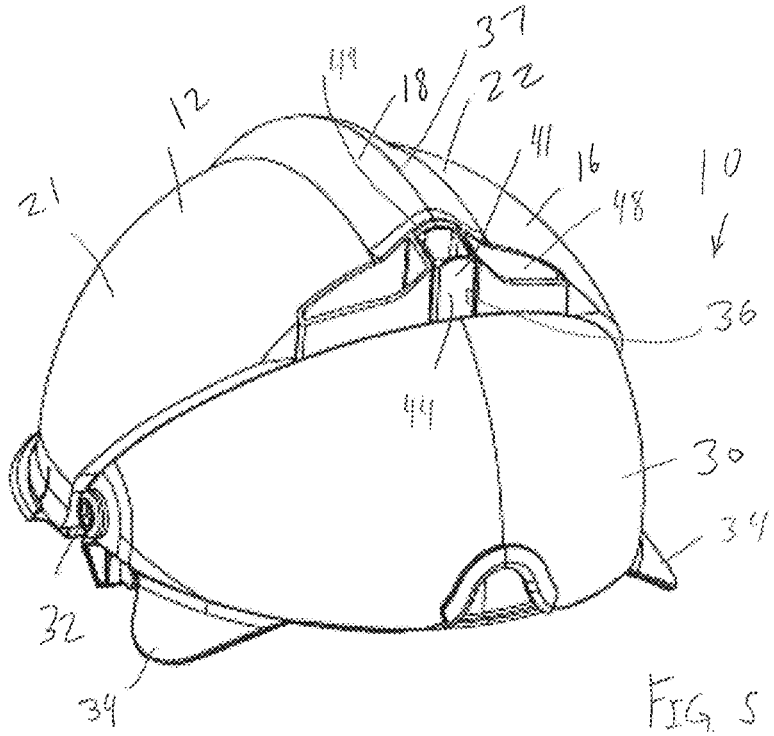
FIG. 5 shows the helmet of FIG. 4, with the shield in a retracted position.
Figure 6:
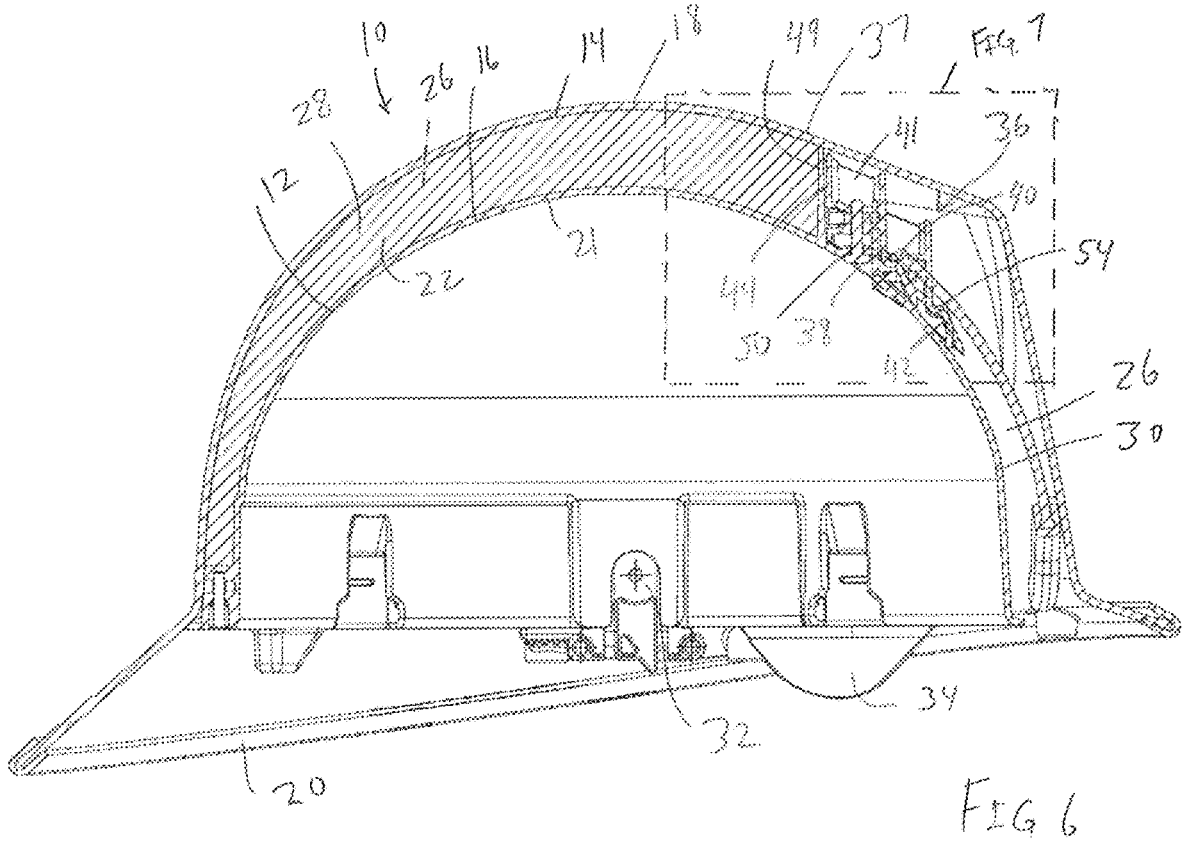
FIG. 6 is a side cross section of the helmet of FIG. 5, with the helmet including the outer shell.
Figure 12:
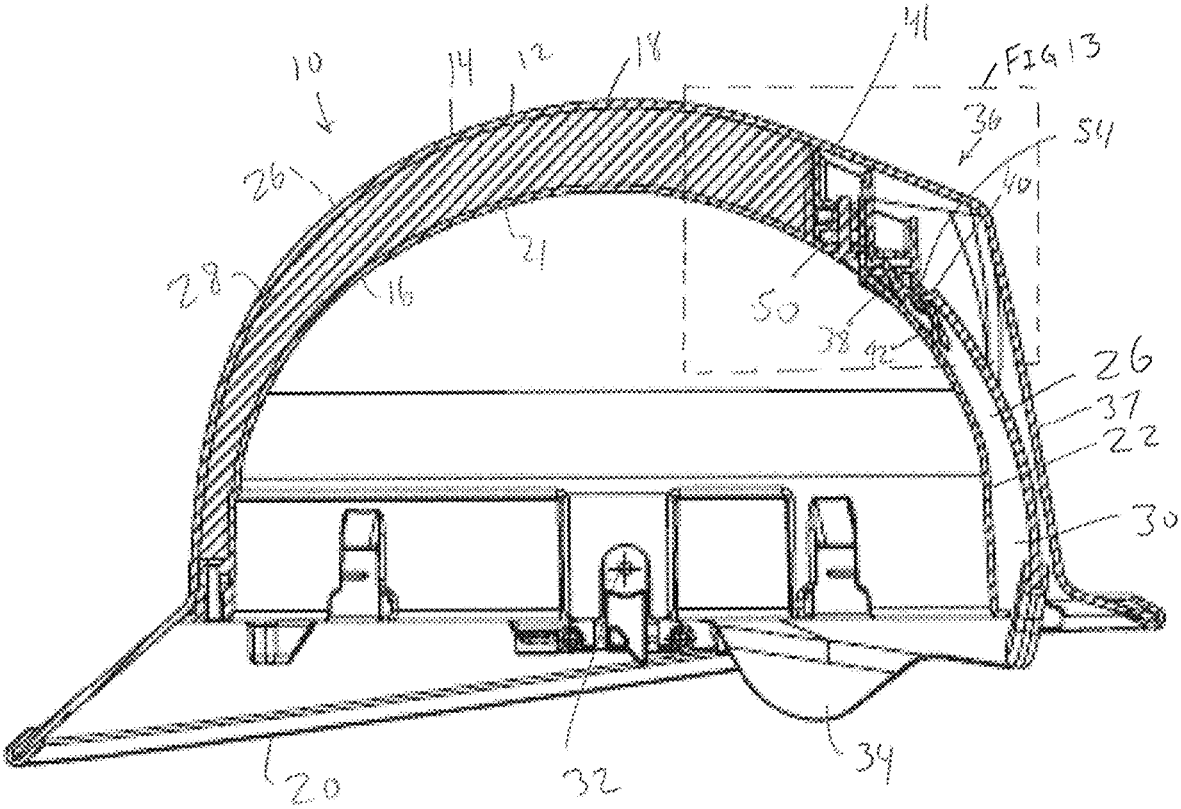
FIG. 12 is a side cross section of the helmet of FIG. 11.

The helmet 10/body 12 can include an inner impact cap, or inner casing 22, positioned inside the outer shell 14. The inner casing 22 can have an inner shell 21 that is made of relatively rigid (but in some case less rigid than the outer shell 14) material, and is generally hemispherical with a ridge 18 and configured to receive the upper portion/crown of a wearer's head therein. The inner shell 21 can be made of the same materials as outlined above for the outer shell 14 and/or nylon, fire resistant polypropylene and/or composite injection molded polymers. With reference to FIGS. 3, 6 and 12, the outer shell 14 and inner shell 21 of the inner casing 22 can be joined at the rear portions at their outer perimeters or at other locations, but at least partially spaced apart at their intermediate locations to define cavity 26 therebetween.

At least part of the cavity 26 can be filled with a filler material 28, such as rigid foam, including expanded polyurethane foam or other materials to provide thermal insulation and/or structural strength to the helmet 10, where the filler material 28 can be considered part of the inner casing 22. The helmet 10/body 12/inner casing 22 can include webbing, straps, headbands and the like (not shown) positioned in the inner casing 22 to enable the helmet 10 to fit onto, and be retained on a head of the wearer in a comfortable manner, and in particular in the orientation shown in FIGS. 1-13. The webbing, straps, headband and the like can in one case be adjustable to provide a custom fit to the wearer.

The helmet 10, and each part or component thereof, can comply with one or more relevant standards including the following standards, the contents of which as of the filing date of this application are incorporated by reference herein:

- NFPA 1970, Standard on Protective Ensenbles for Structural Fire Fighting and Proximity Fire Fighting
- NFPA 1951, Standard on Protective Ensembles for Technical Rescue Incidents
- NFPA 1952, Standard on Surface Water Operations Protective Clothing and Equipment
- NFPA 1977, Standard on Protective Clothing and Equipment for Wildland Fire Fighting and Urban Interface Fire Fighting European Norm ("EN") standards 443, 16473 and 14458 for firefighting helmets, shields and the like set by the European Committee for Standardization (also known as Comité Européen de Normalisation ("CEN")).

The helmet 10 can include or be coupled to a shield 30, where the shield 30 can be movably/pivotally coupled to the body 12, and more particularly the inner casing 22 in the illustrated embodiment. The shield 30 can be transparent/translucent to enable a wearer to see through the shield 30 when the shield is in the deployed position. The shield 30 can be made of any of wide variety of materials, including thermoplastics such as high temperature resistant polycarbonate and/or polyacrylate, or other suitable materials. The shield 30 can be curved and generally shaped as a segment or portion of sphere in one case, tapering to a pair of ends/pivot points 32 in one embodiment (see FIG. 4).

The shield 30 can be pivotally coupled at the two ends/pivot points 32, to the body 12 such that the shield 30 is pivotable about a pivot axis A. The shield 30 is thus pivotable between a stowed/retracted position (FIGS. 5 and 6), where the shield 30 is generally retracted into the outer shell 14 and the cavity 26 and/or is not positioned to be located in front of a wearer's eyes when the helmet 10 is worn, and a deployed/engaged/extended position (FIGS. 1-4) where the shield 30 is generally not retracted and/or is positioned to be located in front of a wearer's eyes when the helmet 10 is worn. When in the retracted position at least about 60%, in one case, or at least about 90% in another case, of the shield 30, by surface area, is positioned in the cavity 26/outer shell 14. When in the retracted position at least about 60%, in one case, or at least about 90% in another case, of the shield 30, by surface area, is positioned outside the cavity 26/outer shell 14.

The shield 30 may also be positionable in a staged/intermediate/partially engaged position (FIGS. 11 and 12) where the shield 30 is still generally located inside the cavity 26/outer shell 14, but is not in the retracted position (and not in the deployed position), and is not positioned to be located in front of a wearer's eyes when the helmet 10 is worn. When in the intermediate position at least about 50%, in one case, or at least about 80% in another case, of the shield 30, by surface area, is positioned in the cavity 26/outer shell 14, but at least part of the shield 30 is not positioned in the cavity 26/outer shell 14.

The shield 30 can include a pair of opposed gripping tabs 34 along its lower edge, which extend below the brim 20 when the shield is in the retracted and/or intermediate positions. The gripping tabs 34 provide a surface which can be gripped and pulled on by the wearer for quick and easy deployment of the shield 30 (e.g. movement of the shield 30 to the deployed position), even when the wearer is wearing gloves.

Figure 7:
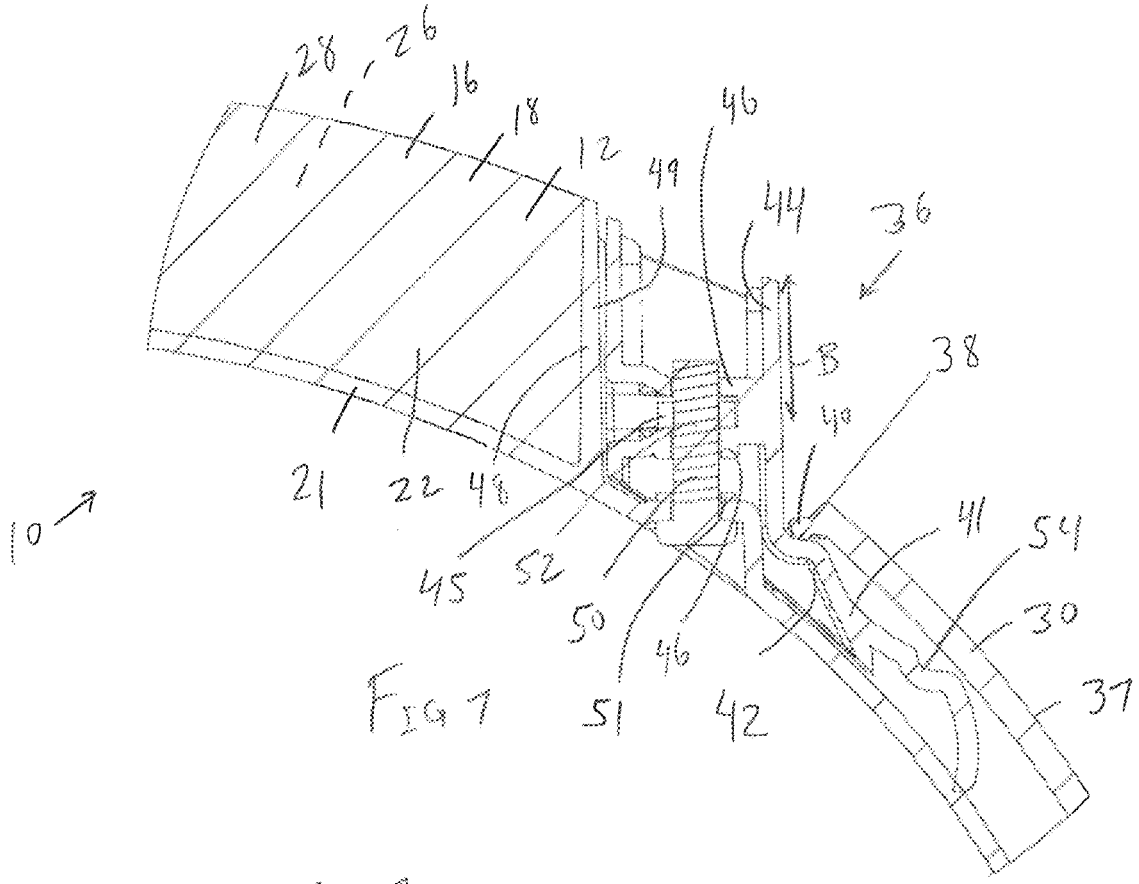
FIG. 7 is detail view of the area indicated in FIG. 6, showing the shield retaining mechanism in a first position, applying tension to the shield, and with the outer shell removed.

The assembly headgear 10/shield 30 can include a retaining mechanism 36 configured to retain the shield 30 in any the retracted position and/or intermediate position. With reference to FIG. 7, the retaining mechanism 36 can include a first circumferentially extending surface, such as a lip 38 located on or coupled to the body 12, and a second circumferentially surface, such as a rib 40 extending surface located on or coupled to the shield 30. The lip 38 and/or rib 40 can extend circumferentially at least 0.5 degree in one case, or at least 1 degrees in another case, and less than 25 degrees in one case, and less than 10 degrees in another case. In addition the lip 38 and/or rib 40 can extend the same distance as each other, or within +/−10% of the circumferential length of each other in one case, or within +/−25% of the circumferential length of each other in another case. The lip 38 and rib 40 may be fixed and not movable in the circumferential direction in one case.

Both the lip 38 and the rib 40 can be positioned/aligned in a radial plane (relative to a frame of reference of the spherical or generally spherical portions of the helmet 10) and/or a generally horizontal plane when the helmet 10 is worn (e.g. aligned in a horizontal plane relative to a gravitational frame of reference when the helmet 10 is worn upon a top of a head of the wearer with, in one case, the front and rear edges of the outer shell 14, with reference to FIGS. 3, 6 and 12, being aligned in a horizontal plane). Of course some variances from horizontal from horizontal, when the helmet 10 is worn, is to be expected (e.g. +/−5 degrees in one case, or +/−10 degrees in another case, or +/−15 degrees in yet another case, depending upon how the helmet 10 is worn).

With reference to FIG. 7, when the shield 30 is in the retracted position, the lip 38 and the rib 40 engage each other to selectively retain the shield 30 in the retracted position. In particular, in one case the lip 38 and the rib 40 are configured to engage each other by frictional engagement, where the frictional engagement is provided/increased by the weight of the shield 30, pulling the rib 40 downwardly into engagement with the lip 38, and/or by forcing the lip 38 and rib 40 against each other in the vertical direction, as will be described in greater detail below. Alternatively or in addition, the lip 38 and rib 40 can be configured to engage each other with interengaging/interlocking shapes or configurations to selectively retain the shield 30 in the retracted position and/or may be pressed against each other to be deflected or tensioned against one another. It should be understood that the designation of the "first" 38 and "second" 40 circumferential surfaces can be reversed from that described above, and the surface 38 on the body 12 can be termed the second circumferential surface, and the surface 40 on the shield 30 can be termed the first circumferential surface.

When the retaining mechanism 36 is shown in FIG. 7 is utilized, the shield 30 is retained in the retracted position and prevented from freely moving to the intermediate and/or engaged positions. However the shield 30 can be manually moved away from the retracted position, to one, or both, of the intermediate and engaged positions, by manually gripping the shield 30 and applying a force tending to cause the shield to pivot downwardly about axis A in one case. Once the manually applied force overcomes the static friction force, or other locking features, of the retaining mechanism 36 the shield 30 can be moved away from the retracted position. Thus the lip 38 and the rib 40 are configured to engage each other to selectively retain the shield 30 in the retracted position such that a user can manually apply a force to move the shield 30 from the retracted position to the engaged position. The force required to move the shield 30 away from the retracted position (and/or from the intermediate position) can be termed the release force, and can be greater than about 0 lbs. in one case, or greater than about 1 lb. in another case, or greater than about 3 lbs. in yet another case, or greater than about 5 lbs., in yet another case, and/or less than about 20 lbs. in one case and/or less than about 10 lbs. in yet another case.

Figure 10:
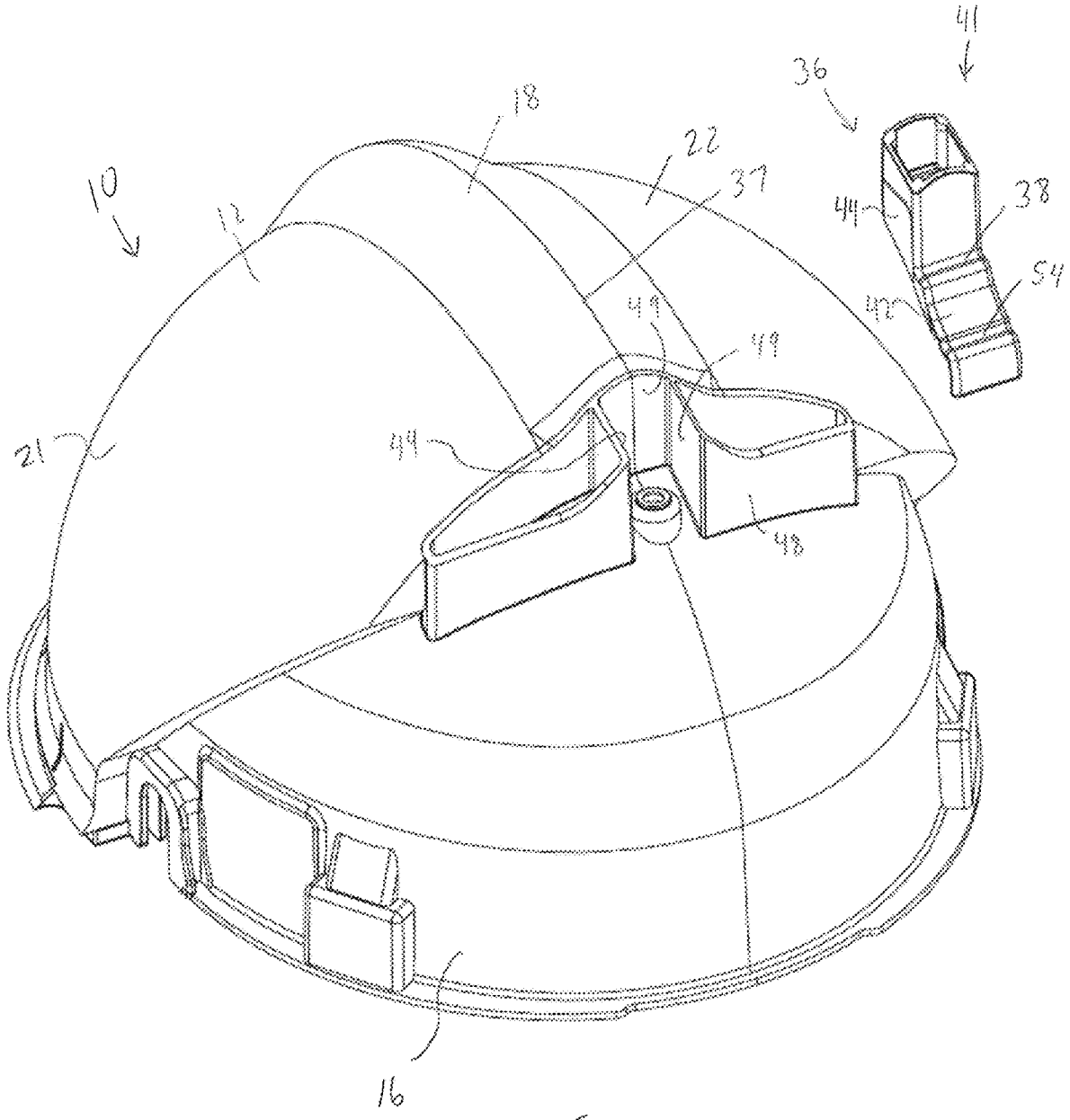
FIG. 10 shows part of the helmet of FIG. 4, with the shield retaining assembly exploded away.
Figure 11:
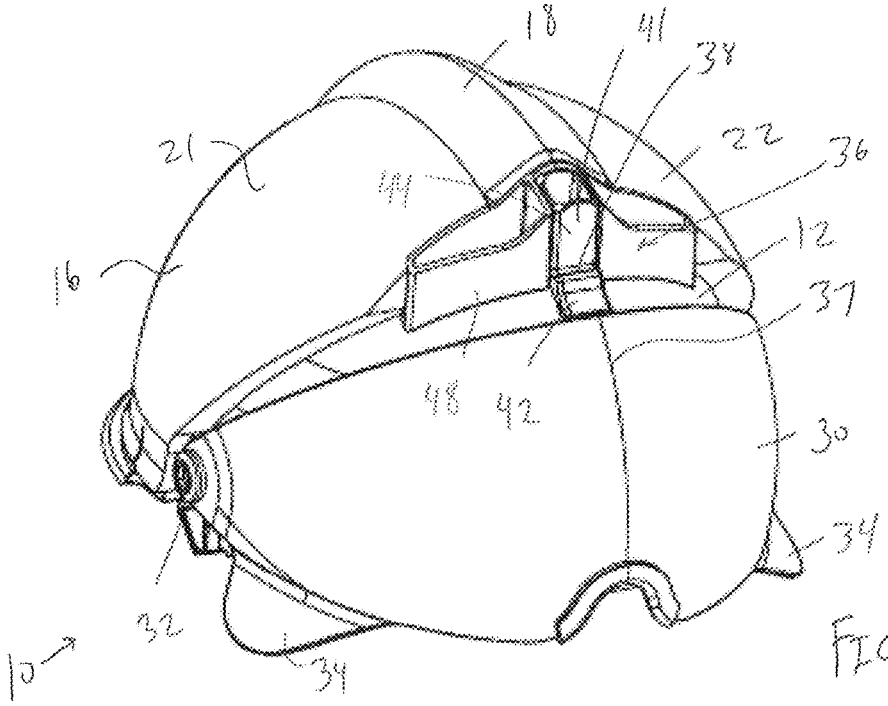
FIG. 11 shows the helmet of FIG. 4, with the shield in an intermediate position.

In some cases the retaining mechanism 36 can be adjusted to adjust the release force. More particularly, in one case at least part of the retaining mechanism 36 (e.g. a retaining assembly 41, as described below) is adjustable, in direction B (FIG. 7) in one case (e.g. in a direction perpendicular to the pivot axis A) to adjust the engagement between the lip 38 and the rib 40, to thereby adjust the release force. With reference to FIG. 7, the retaining mechanism 36 can include the retaining assembly 41 including a retaining arm 42 that is coupled to or includes the lip 38. The retaining assembly 41 can further include a generally vertically oriented, hollow support tube 44 having a generally rectangular cross section in one case, which is coupled to the retaining arm 42 at a lower end of the support tube 44. The retaining assembly 41/support tube 44 has a pair of horizontally oriented, vertically spaced spars 46 extending between the opposed walls of the support tube 44, and located inside the support tube 44. As best shown in FIG. 10, the support tube 44 is (vertically) slidably mounted in guide structure 48 having three inner walls 49 that closely receive the retaining assembly 41/support tube 44 therein.

Figure 8:
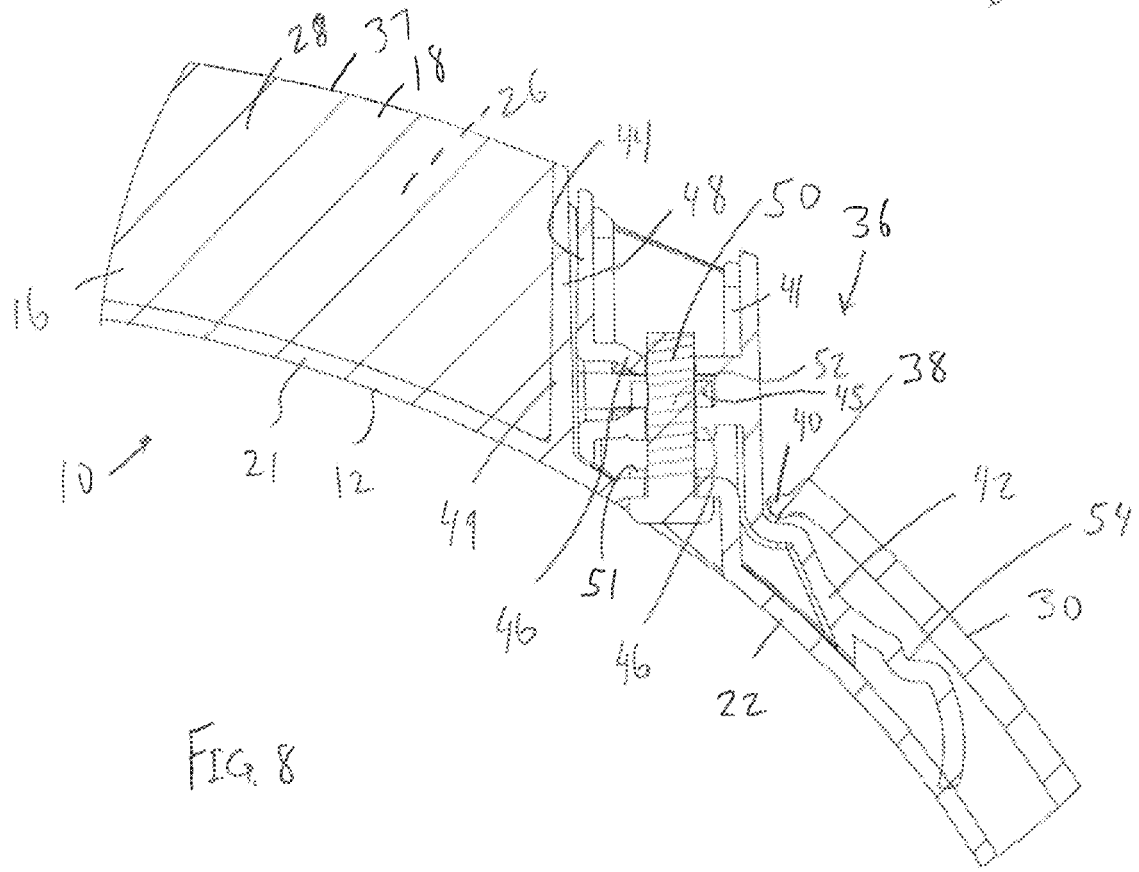
FIG. 8 shows the retaining mechanism of FIG. 7 in a different position, with the tension removed.
Figure 9:
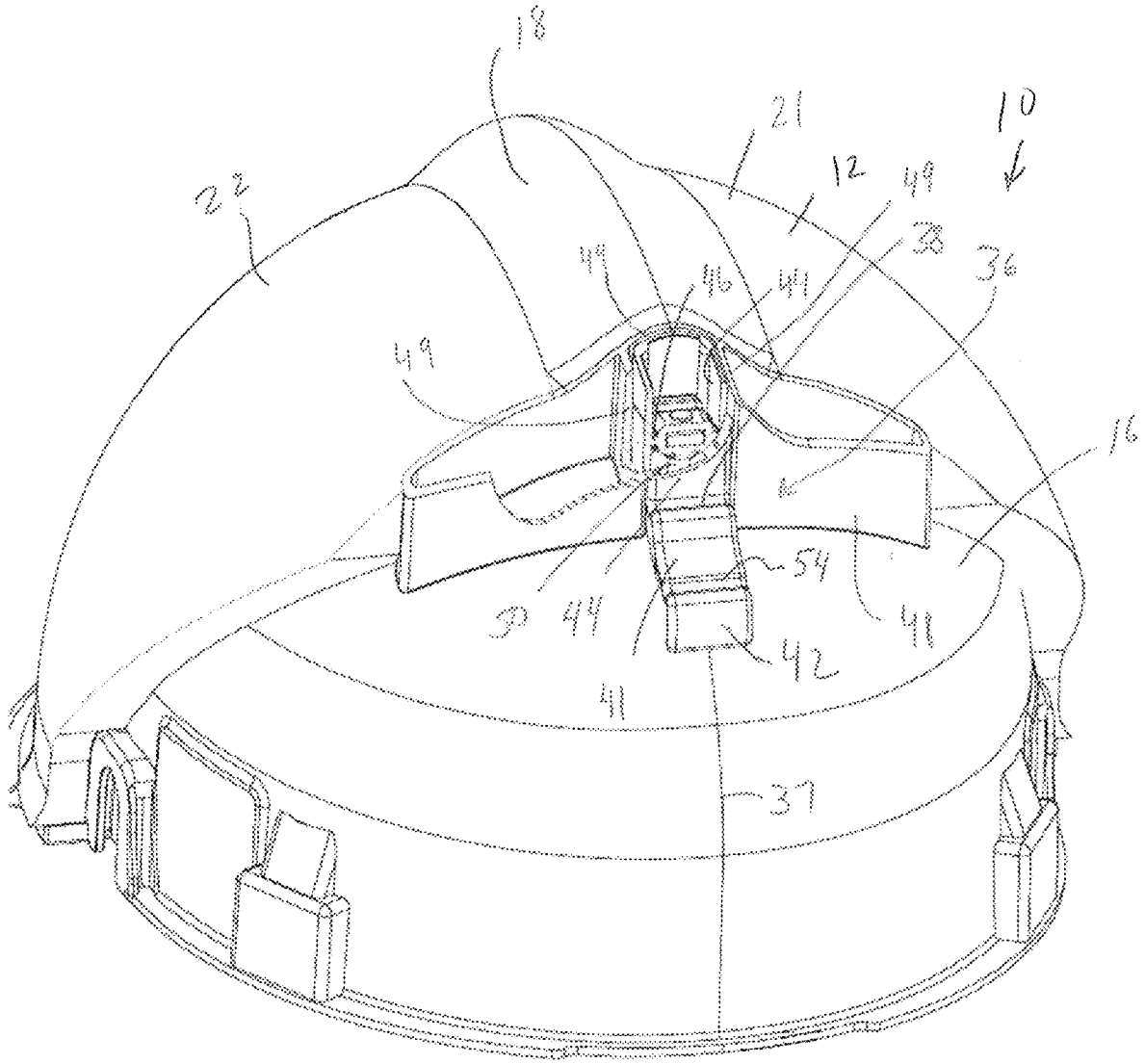
FIG. 9 shows part of the helmet of FIG. 4, with the shield removed and a portion of the retaining mechanism cut away.

With reference to FIGS. 7 and 8, the retaining mechanism 36 can have an actuator in the form of rotatable threaded body 50 having a threaded shaft 52 that is threadably coupled to the retaining assembly 41, and more particularly threadably coupled to a nut 45 trapped between the spars 46 of the support tube 44. In the illustrated embodiment the actuator/threaded body 50 is located on the body 12 and does not move with the shield 30 when the 30 is pivoted. The actuator/threaded body 50 is thereby operable/rotatable to move the retaining assembly 41, and thus the support tube 44, retaining arm 42 and the lip 38, in the vertical direction B (with regard to a gravitational frame of reference as outlined above).

In particular, by rotating the threaded body 50 in a first direction the retaining arm 42/lip 38 is vertically raised to increase the frictional and/or interlocking engagement between the lip 38 and the rib 40, and/or increase the applied tension/deflection of the retaining lip 38 and/or rib 40, thereby increasing the retaining force, as can be seen in comparing FIG. 7 and FIG. 8. Conversely, by rotating the threaded body 50 in a second direction opposite to the first direction, the retaining arm 42/lip 38 is vertically lowered and decreases the frictional engagement and/or interlocking arrangement between the lip 38 and the rib 40, decreasing the retaining force. FIG. 8 illustrates the case where the arm 42 and lip 38 are lowered and entirely spaced away from the rib 40/shield 30, effectively reducing the release force to zero. The retaining mechanism 36 can include a screw retainer 51 that receives the threaded shaft 52 therethrough to enable the threaded shaft 52 to stay in the same position when moving the support tube 44, and to retain the threaded shaft 52 in the support tube 44, particularly when the threaded shaft 52 is unthreaded from the nut 45.

Thus the retaining mechanism 36 can in one case take the form or, or be analogous to, a jackscrew. Moreover, in the illustrated embodiment the retaining mechanism 36 and/or actuator 50 is located at a front center of the helmet 10, and the illustrated embodiment is spaced away from, and not aligned with, the pivot points 32 of the shield 30. It should be understood that the location of the retaining mechanism 36 and/or actuator 50 can be reversed from that shown, and that the retaining mechanism 36 and/or actuator 50 can in one case be located on the shield 30 instead of the body 12. The retaining mechanism 36 and/or actuator 50 can be located on, or at least partially located on or overlap with, or be aligned with, a lateral centerline 37 of the helmet 10/body 12 (e.g. aligned with a sagittal plane of the wearer), extending in a front-to-back direction of the helmet 10. The actuator/threaded body 50 can be manually accessible and manually adjustable. In this manner the user/wearer can adjust the retaining force to the desired levels. In addition, the actuator/threaded body 50 can be located on the body 12 of the helmet 10, and not on the shield 30, which can reduce the weight and/or increase the ability to freely move the shield 30, and also provide a consistent, known location for the wearer to access.

Figure 13:
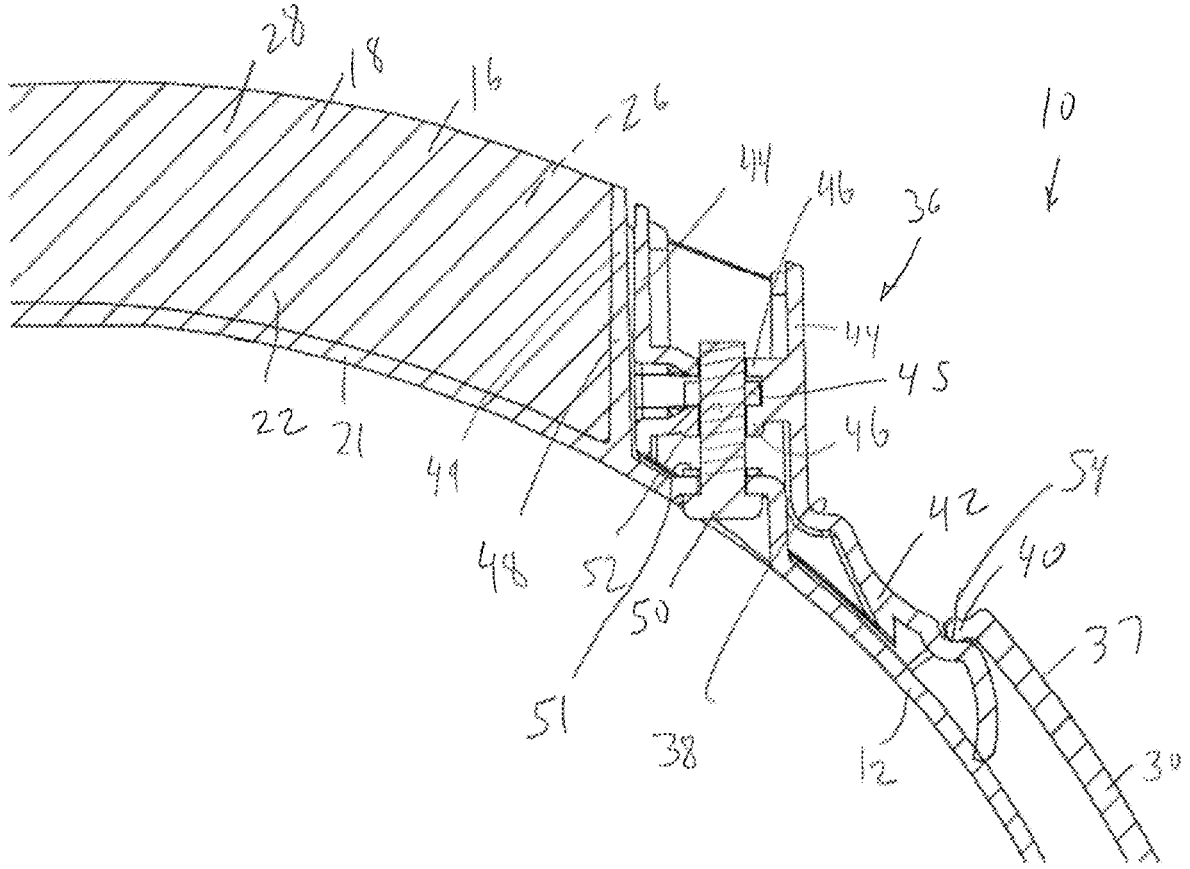
FIG. 13 is a detail view of the area indicated in FIG. 12, with the outer shell removed and the shield in the intermediate position.

With reference to FIG. 13, the retaining mechanism 36/retaining assembly 41/retaining arm 42 can include a third circumferentially extending surface/supplemental lip 54. The supplemental lip 54 is positioned/aligned in a radial plane and/or a generally horizontal plane when the helmet 10 is worn. The supplemental lip 54 can be parallel with, but spaced away from the (first) lip 38. For example the supplemental lip 54 can be located at a lower vertical position and/or a forward position as compared to the lip 38, so that that the shield 30 can be retained in the desired (intermediate) position. The supplemental lip/third surface 54 can be configured to frictionally or otherwise engage the rib 40 to retain the shield 30 in the intermediate position. The supplemental lip 54 can also be coupled or form part of the retaining assembly 41/retaining arm 42, such that rotation of the threaded body 50 also automatically adjusts the retaining force between the supplemental lip 54 and the rib 40, in the same manner, and at the same time, that the retaining force between the lip 38 and the rib 40 is adjusted.

The adjustable nature/applied force of the retaining mechanism 36 enables the user/wearer to adjust the retaining force applied to the shield 30 to the desired levels. The adjustable retaining mechanism 36 also enables the retaining force to be adjusted over time. In particular, various components of the retaining mechanism 36 can deform, elongate, shrink, be bumped etc. over time, which can cause the retaining force to increase or decrease in an undesirable manner. The adjustable retaining mechanism 36 can enable the user/wearer to return the retaining force to desired levels. Finally, the retaining mechanism 36 can allow a different user/wearer to customize the retaining force to the desired level for that particular user. The adjustment can be quickly, easily and intuitively instituted, and can automatically apply to the retracted and/or intermediate positioning of the shield 30.

Having described the invention in detail and by reference to certain embodiments, it will be apparent that modifications and variations thereof are possible without departing from the scope of the invention.

What is claimed is:

1. A headgear assembly comprising:

a body configured to fit on a head of a wearer;

a shield coupled to the body, the shield being movable between an extended position where the shield is positioned to cover at least part of a face of the wearer, and a retracted position where the shield is positioned to not cover the face of the wearer, or to cover less of the face of the wearer compared to when the shield is in the extended position; and a retaining mechanism including a first surface located on one of the body or the shield, and a second surface located on the other one of the body or the shield, wherein the first and second surfaces are configured to be able to engage each other when the shield is in the retracted position to selectively retain the shield in the retracted position, wherein at least part of the retaining mechanism is manually adjustable and configured such that after manual adjustment is complete, a force required to move the shield away from the retracted position is thereby modified.

2. The assembly of claim 1 wherein the first surface includes a lip located on the body and the second surface includes a rib located on the shield, and wherein the first surface and second surface both extend circumferentially.

3. The assembly of claim 1 wherein the first surface and the second surface are configured to engage each other by at least one of frictional engagement or by interengaging shapes or by interlocking shapes to selectively retain the shield in the retracted position.

4. The assembly of claim 1 wherein the retaining mechanism includes a third surface, wherein the third surface is configured to be able to engage one of the first or second surfaces to retain the shield in an intermediate position between the extended position and the retracted position.

5. The assembly of claim 1 wherein the shield is pivotable about an axis between the extended position and the retracted position, and wherein the at least part of the retaining mechanism is adjustable in a direction perpendicular to the axis to adjust the engagement between the first and second surfaces, to thereby modify the force required to move the shield away from the retracted position.

6. The assembly of claim 5 wherein the first surface is coupled to or forms part of a retaining arm, wherein the retaining arm is coupled to the body by a threaded shaft, wherein the threaded shaft is configured such that rotation of the threaded shaft moves the retaining arm and the first surface in the direction perpendicular to the axis.

7. The assembly of claim 5 wherein the retaining mechanism includes a third surface, wherein the third surface is configured to be able to engage one of the first or second surfaces to retain the shield in an intermediate position between the extended position and the retracted position, and wherein the retaining mechanism is configured such that adjustment of the retaining mechanism in the direction perpendicular to the axis adjusts the engagement between the third surface and the one of the first or second surfaces, to thereby adjust a force required to move the shield away from the intermediate position.

8. The assembly of claim 1 wherein the first surface is coupled to the body, and wherein the first surface adjustable in a vertical direction relative to a gravitational frame of reference when the assembly is worn upon a top of the head of the wearer, to thereby adjust the engagement between the first and second surfaces, to thereby adjust a force required to move the shield away from the retracted position.

9. The assembly of claim 1 wherein the headgear is a helmet and the body includes a rigid outer shell and an inner casing, wherein the shield is configured to be at least partially positioned between the shell and the casing when the shield is in the retracted position, and wherein the shield is transparent or translucent.

10. The assembly of claim 1 wherein the shield is pivotally coupled to the body at a pair of pivot points, and wherein the retaining mechanism is spaced away from both pivot points.

11. The assembly of claim 1 wherein the first and second surfaces are configured to engage each other when the shield is in the retracted position to selectively retain the shield in the retracted position such that a user can manually apply the force to the shield, to thereby move the shield away from the retracted position.

12. The assembly of claim 1 wherein the retaining mechanism includes a threaded shaft, and wherein the retaining mechanism is configured such that rotation of the threaded shaft modifies the force required to move the shield away from the retracted position.

13. The assembly of claim 1 wherein the at least part of the retaining mechanism is manually adjustable and configured such that after manual adjustment is complete such that a user is no longer manually operating the retaining mechanism, the force required to move the shield away from the retracted position is thereby modified.

14. The assembly of claim 1 wherein the retaining mechanism is configured to engage the shield and retain the shield in the retracted position, and wherein the shield is manually movable from the retracted position to the extended position when a sufficient manual force is applied to the shield without operation of the retaining mechanism.

15. The assembly of claim 1 wherein the assembly is configured such that the retaining mechanism does not engage the shield when the shield is in the extended position.

16. A headgear assembly comprising:

a body configured to fit on a head of a wearer;

a shield coupled to the body, the shield being movable between an extended position where the shield is positioned to cover at least part of a face of the wearer, and a retracted position where the shield is positioned to not cover the face of the wearer, or to cover less of the face of the wearer compared to when the shield is in the extended position; and a retaining mechanism including a first surface located one of the body or the shield, and a second surface located on the other one of the body or the shield, wherein the first and second surfaces are configured to be able to engage each other when the shield is in the retracted position to selectively retain the shield in the retracted position, wherein the retaining mechanism includes a third surface, wherein the third surface is configured to be able to engage one of the first or second surfaces to retain the shield in an intermediate position between the extended position and the retracted position, wherein the third surface is located on the shield and is configured to be able to engage the one of the first or second surfaces located on the body, and wherein the third surface is oriented parallel to and spaced away from the one of the first or second surfaces on the shield.

17. A headgear assembly comprising:

a body configured to fit on a head of a wearer;

a shield coupled to the body, the shield being movable about an axis between an extended position where the shield is positioned to cover at least part of a face of the wearer, and a retracted position where the shield is positioned to not cover the face of the wearer, or to cover less of the face of the wearer compared to when the shield is in the extended position; and a retaining mechanism including a first surface located on one of the body or the shield, and a second surface located on the other one of the body or the shield, wherein the first and second surfaces are configured to be able to engage each other when the shield is in the retracted position to selectively retain the shield in the retracted position, wherein at least part of the retaining mechanism is adjustable in a direction perpendicular to the axis to adjust the engagement between the first and second surfaces, to thereby adjust a force required to move the shield away from the retracted position, wherein the first surface is coupled to or forms part of a retaining arm, and wherein the retaining arm is coupled to the body by a threaded shaft that is configured such that rotation of the threaded shaft moves the first surface relative to the second surface.

18. The assembly of claim 17 wherein the first surface is located on the body, and wherein the first surface is adjustable in a vertical direction relative to a gravitational frame of reference when the assembly is worn upon a top of the head of the wearer to thereby adjust the force required to move the shield away from the retracted position.

19. The assembly of claim 17 wherein the first surface is coupled to or forms part of a retaining assembly, wherein the retaining assembly is adjustable to thereby adjust the force required to move the shield away from the retracted position, and wherein at least part of the retaining assembly is aligned with a lateral centerline of the body.

20. The assembly of claim 17 wherein the first and second surfaces each extend circumferentially, wherein the first and second surfaces are each aligned in an associated horizontal plane relative to a gravitational frame of reference when the assembly is worn upon a top of the head of the wearer.

21. The assembly of claim 17 wherein the headgear assembly is configured such that rotation of the threaded shaft, that moves the first surface relative to the second surface, thereby modifies a force required to move the shield away from the retracted position.

22. A headgear assembly comprising:

a body configured to fit on a head of a wearer;

a shield coupled to the body, the shield being movable between an extended position where the shield is positioned to cover at least part of a face of the wearer, and a retracted position where the shield is positioned to not cover the face of the wearer, or to cover less of the face of the wearer compared to when the shield is in the extended position; and a retaining mechanism including a first surface located on one of the body or the shield, and a second surface located on the other one of the body or the shield, wherein the first and second surfaces are configured to be able to engage each other when the shield is in the retracted position to selectively retain the shield in the retracted position, wherein the retaining mechanism includes an actuator located on the body that is rotatably adjustable to adjust the engagement between the first and second surfaces, to thereby adjust a force required to move the shield away from the retracted position.

23. The assembly of claim 22 wherein the first surface is coupled to or forms part of a retaining arm, wherein the retaining arm is coupled to the body by the actuator which includes a threaded shaft, wherein the actuator is configured such that rotation of the actuator moves the retaining arm and the first surface relative to the second surface to thereby adjust the force required to move the shield away from the retracted position.

24. The assembly of claim 22 wherein the shield is pivotable about an axis, and wherein the retaining mechanism is adjustable in a direction perpendicular to the axis to adjust the engagement between the first and second surfaces, to thereby adjust the force required to move the shield away from the retracted position.

25. The assembly of claim 22 wherein the first and second surfaces each extend circumferentially, wherein the first and second surfaces are each aligned in an associated horizontal plane relative to a gravitational frame of reference when the assembly is worn upon a top of the head of the wearer.

* * * * *